United States Patent [19]

O'Sullivan

[11] Patent Number: 4,768,248

[45] Date of Patent: Sep. 6, 1988

[54] HEALTH PILLOW CONSTRUCTION AND METHOD THEREFOR

[76] Inventor: Dennis O'Sullivan, 150 Neptune, Encinitas, Calif. 92024

[21] Appl. No.: 105,888

[22] Filed: Oct. 6, 1987

[51] Int. Cl.[4] ..... A47G 9/00

[52] U.S. Cl. ..... 5/437; 5/442

[58] Field of Search ..... 5/434, 436, 437, 440, 5/442, 462, 441

[56] References Cited

U.S. PATENT DOCUMENTS

| | | | |
|---|---|---|---|
| 655,087 | 7/1900 | Jones | 5/436 |
| 1,446,290 | 2/1923 | Dessan | 5/462 |
| 3,443,267 | 5/1969 | Schuckman | 5/442 |

FOREIGN PATENT DOCUMENTS

| | | | |
|---|---|---|---|
| 2067897 | 8/1981 | United Kingdom | 5/462 |

*Primary Examiner*—Alexander Grosz
*Attorney, Agent, or Firm*—David J. Harshman

[57] ABSTRACT

The improved health pillow construction for receiving the head and neck of the user in a resting position comprises a cover having a first and second wall, and a partition interposed between the first and second walls so as to define a first and second chamber, respectively. Soft filler material is enclosed within the first chamber for comfortably supporting the head. Enclosed within the second chamber is a firm neck support member which is slidably moveable within the second chamber, so that the neck support member can easily be shifted from one position to another within the chamber. This enables the user to conveniently adapt the pillow to provide firm support for the neck while providing satisfactory head support. The neck support member is preferably in a cylindrical roll shape and is of a firm material, such as hard latex, or polyester fiber tightly packed within a covered fabric. The neck roll preferably has a diameter approximately in the range of 20 to 30 percent of its height. A method is also disclosed for constructing the improved health pillow.

9 Claims, 2 Drawing Sheets

HEALTH PILLOW CONSTRUCTION AND METHOD THEREFOR

BACKGROUND OF THE INVENTION

1. Field of the Invention

This invention relates to an improved health pillow construction, and in particular to a head and neck support to the user which provides greater support and comfort for the user.

2. Description of the Prior Art

Conventional pillows as found in the prior art are constructed of a filler or latex body being of equal firmness throughout, resulting in a pillow having a body so soft that the neck support area compresses to result in no support. In the alternative, the body is so firm that the head sits considerably higher than the shoulders of the user resulting in an abnormal sleeping or resting position. This creates a feeling of stiffness or soreness in the neck region of the user.

Many types of pillows have been designed to provide firm support for the neck region while providing a soft support for the head. One such pillow construction is that disclosed in U.S. Pat. No. 3,521,310, which discloses a pillow comprising a pair of firm outer members sandwiching a relatively soft intermediate member. This type of pillow construction, however, has the disadvantage of many such attempts to provide appropriate neck support in that the firm portion of the neck support may not be in the proper position relative to the head support portion for maximum comfort and support with respect to the user. If such a pillow is moved to provide better support for the neck, the rest of the pillow may not be in a position to provide the soft comfort required for the head, and vice versa. This is especially true if a pillow such as that disclosed in said patent is of a size wherein the second firm member is not at a place appropriate for the upper part of the head of the user. This depends on the sizes of different users, and for example the distance from the shoulder area to the neckline, and the distance from the neckline to the occipital and temporal areas at the back and sides, respectively, of the head.

Moreover, such a rigid construction results in increased manufacturing costs and lack of durability. Such types of pillows intended to provide neck support typically may be complicated and manufactured to conform to specific dimensions for specific users. Such pillows are not readily adapted to be suitable for a wide range of users yet provide maximum support and comfort for the user.

Other conventional neck support pillows include a cylindrical neck roll for being placed under the neck of the user. However, such neck rolls provide little or no support for the head, and are thus uncomfortable after a period of time. Another type of pillow is a neck roll pillow which consists of a cylindrical neck roll attached in a parallel position along one edge of a standard pillow. It requires a special pillow case and also does not easily adapt to the needs of the user in terms of providing comfortable support for the user depending on the resting position of the user.

Finally, conventional pillow constructions do not provide a sturdy yet convenient pillow construction, nor do they adequately solve the problem of providing a soft support, yet a firm support at the same time, for different resting positions of the head and neck, respectively.

SUMMARY OF THE INVENTION

It is an object of the present invention to provide an improved pillow construction.

It is another object of the present invention to provide a pillow having a firm support for the neck which is readily adaptable to accommodate the user by easily adjusting to provide firm neck support for the user, while still providing a relatively soft and comfortable support member for the head.

It is a further object of the present invention to provide a pillow construction which may be inserted in an ordinary pillow case.

It is yet another object of the present invention to provide a pillow which provides adequate support for the neck when the user is resting on one side or in a supine position.

It is a further object of the present invention to provide a pillow which is simple in construction, economical in use, and which will retain its shape.

It is yet another object of the present invention to provide a pillow construction which is durable and reliable to use.

It is yet another object of the present invention to provide a pillow which is economical to manufacture.

Further objects of the present invention will become apparent in the full description of the invention taken in conjunction with the drawings set forth below.

The improved health pillow construction for receiving the head and neck of the user in a resting position comprises a cover having a first and second wall, and a partition interposed between the first and second walls so as to define a first and second chamber, respectively. Soft filler material is enclosed within the first chamber for comfortably supporting the head. Enclosed within the second chamber is a firm neck support member which is slidably moveable within the second chamber, so that the neck support member can easily be shifted from one position to another within the chamber. This enables the user to conveniently adapt the pillow to provide firm support for the neck while providing satisfactory head support. The neck support member is preferably in a cylindrical roll shape and is of a firm material, such as hard latex, or polyester fiber tightly packed within a covered fabric. The neck roll preferably has a diameter approximately in the range of 20 to 30 percent of its height. A method is also disclosed for constructing the improved health pillow.

DETAILED DESCRIPTION OF THE DRAWINGS

Figure 4:
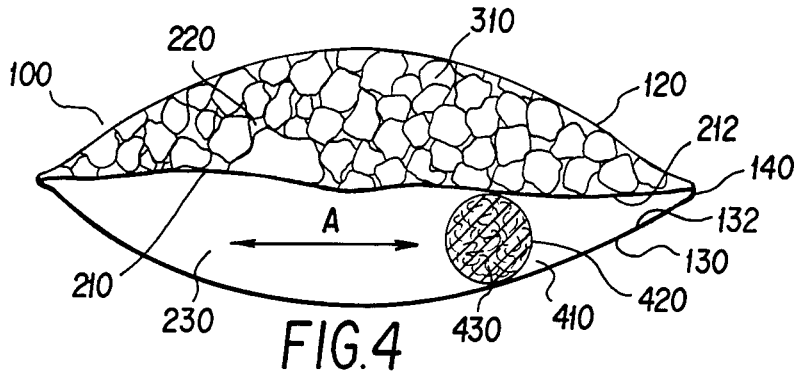
FIG. 4 is a cross-sectional view of the embodiment shown in FIG. 1 taken along line 4—4 of FIG. 1.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 1:
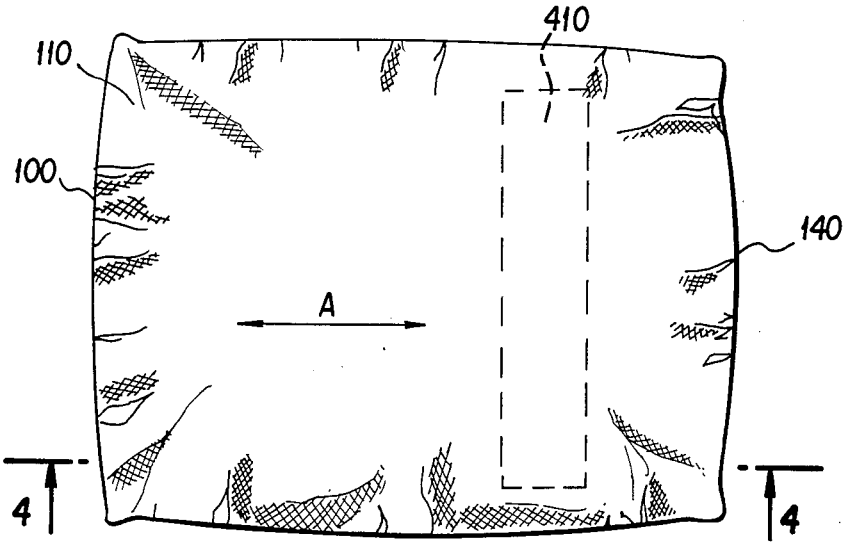
FIG. 1 is a diagrammatic plan view of a preferred embodiment of an improved health pillow in accordance with the present invention.
Figure 5:
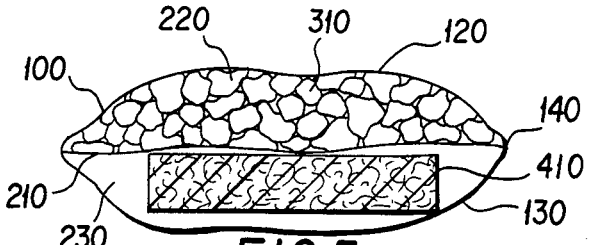
FIG. 5 is a cross-sectional view of the embodiment shown in FIG. 2 taken along line 5—5 of FIG. 2.

Referring to the drawings, in FIGS. 1, 4, and 5 there is shown an improved health pillow 100 having cover means 110, including a first wall 120 and second wall 130. In the embodiment shown, the walls are made of comfortable fabric material, such as polycotton cover fabric, or such other fabric as commonly used in pillow construction. The walls 120 and 130 are joined along edge 140 and secured together as by common fastening of fabric such as sewing or other equivalent connecting method. Interposed between the first wall 120 and second wall 130 is a partition 210, which is also connected at its edges 140. The first wall 120 and partition 210 enclose and define a first chamber 220, and second wall 130 and partition 210 enclose and define a second chamber 230. Soft filler material 310 is enclosed within the first chamber 220 to provide soft resilient bulk as desired. Preferably a soft, resilient material that is suited for comfortably supporting the head is used. One such material is polyester fiber filler. Enough of the polyester fiber filler is contained within the first chamber so as to provide a soft support generally for the head and shoulder area, typically, of the user.

Within the second chamber 230 there is enclosed a neck support member 410. The neck support member 410 is of a less soft, preferably resilient material having the characteristic of being firm. This may be accomplished by constructing the neck support member 410 of a firm, solid resilient material such as hard latex or firm foam rubber. In another embodiment, the neck support member 410 may include a fabric cover 420, within which is tightly packed neck support material 430 so as to give the neck roll the physical characteristic of being firm. The neck support material could also comprise polyester fiber filler packed tightly within cover 420 so as to provide a relatively hard neck support surface.

In a preferred embodiment, the neck support member 410 is preferably a cylindrical roll shaped member. It is generally of a shape preferably having a diameter approximately in the range from 20 to 30 percent of its height. In a preferred embodiment, the roll is approximately 15 inches in height, and approximately 3 to 4 inches in diameter. This dimension approximates the general neck supporting requirements for a great percentage of the population. However, other sizes could be utilized as required.

Also, in the preferred embodiment as shown, the health pillow 100 is generally square in shape. A preferable dimension is approximately 20 inches for the length of each side of the square. Other shapes could be utilized, but the square shape appears to give great advantages for flexibility and adaptability for use.

The cover material 420, and the material utilized for the partition 210 and the second wall 130, are of materials which provide little friction between the neck support member 430 and the inside surfaces 132 and 212 of second chamber 230. Such low friction allows the user to slide firm neck support member 430 and cause it to glide about relatively effortlessly in the second chamber 230. In this manner, the user can conveniently and quickly place the neck support member into the desired position for use.

Figure 2:
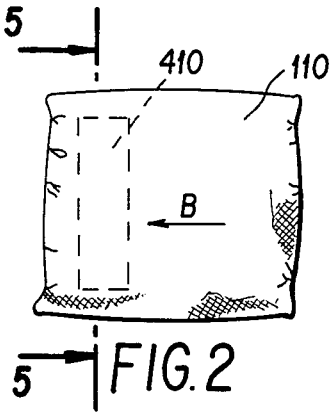
FIG. 2 is a diagrammatic plan view of the embodiment shown in FIG. 1 representing an alternative configuration when in use.
Figure 3:
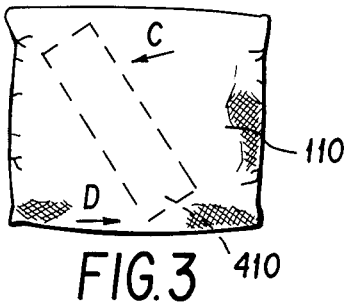
FIG. 3 is a diagrammatic plan view of the embodiment shown in FIG. 1 showing an alternative configuration when in use.

In FIGS. 1, 2, and 3 there is shown the firm neck support member 410 in various positions during use of the improved health pillow 100. In FIG. 1, there is shown an axis A along which the neck support member 410 can be moved, for example. In FIG. 2 there is shown the neck support member 410 having force applied along axis B so that it has been moved from the position shown in FIG. 1 to the different position shown in FIG. 2. In FIG. 3, there is shown the neck support member 410 having force applied along both axis C and axis D in the directions of the arrows shown whereby the neck support member is moved to a diagonal orientation or position. These exemplify the ability of the present invention to readily adapt to various configurations of use as required by the individual user.

Figure 6:
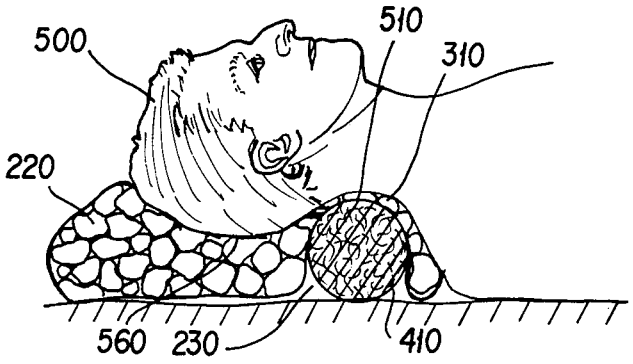
FIG. 6 is a cross-sectional side elevational view of the invention in use by an individual in a supine position.

In operation, there is shown in FIG. 6 one use of the present invention of an individual user in the supine position, or flat on his back. In this particular use of the invention, the neck support member 410 is placed under the neck 510 of the user, with chamber 220 containing soft filler material being positioned over the neck support member 410. In this particular example shown, the soft head support chamber for supporting the head 500 of the user also has the filler material 310 located between the firm neck support member 410 and the neck 510 of the user. There is shown a representation of the chamber 230 being exaggerated to show the operation of the improved health pillow. The firm neck support member 410 positioned under the neck stretches the neck muscles and provides firm support generally throughout the area of the neck 510, while providing relatively soft support for the occipital area 560 of the head 500.

Figure 7:
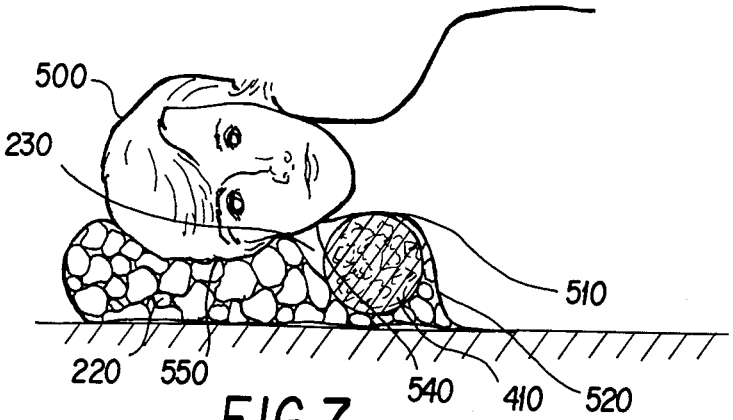
FIG. 7 is a cross-sectional side elevational view of the invention in an alternative mode of use by an individual resting on his side.

In FIG. 7 there is shown an alternative use of the improved health pillow disclosed herein with the individual user being in the supine position, and the improved health pillow being used in a position inverted from that shown in FIG. 6. The second chamber 230 containing the neck support member 410 is utilized on the top, with chamber 220 filled with the softer resilient material being on the bottom. As in the supine position, when the user is in the position of lying on his side, the firm neck support member 410 provides firm hard support of the neck area and tends to fill the space created by the contour of the user's shoulder 520, neck 510, and cheek area 540. If it is desired to stretch the neck muscles, this particular position is helpful, since it creates a space beneath the cheek 540 in chamber 230, yet provides adequate support to the temporal area 550 of the user's head by the soft resilient support of the filler material within chamber 220. If the opposite effect is desired, the pillow can be inverted as disclosed in the example shown in FIG. 6. Also it should be readily apparent that variations on positioning of the pillow may be used, such as a generally diagonal positioning of the neck support member 410 as shown in FIG. 3. This would provide more soft pillow material under the back or shoulder of the user.

A major advantage of the present invention is that the health pillow construction can be utilized in a conventional pillow environment, and regular pillow slips can be utilized. In addition, the pillow maintains its firm neck support characteristic throughout the time of use for the pillow, i.e., throughout the night, for example. The settling of contents which would normally occur with a regular soft pillow is not a problem. The discomfort associated with a hard neck roll is also avoided with the presented invention. In addition, the simple yet convenient construction of the pillow lends itself to reduced costs in manufacture thereof while realizing the advantages of the characteristics contained in such a pillow and overcoming the problems of the prior art. The pillow is readily adaptable to all sizes of users and all physical characteristics by virtue of the fact that the neck support member 410 is readily moveable within the second chamber to slidably adapt to conform to the support characteristics required, without compromising soft comfort for the head.

Although the present invention has been shown and described in terms of specific preferred embodiments, it will be appreciated by those skilled in the art that changes or modifications are possible which do not depart from the inventive concepts described and taught herein. Such changes and modifications are deemed to fall within the purview of these inventive concepts. Thus, it should be noted that the accompanying description and drawings are meant to describe the preferred embodiments of the invention, but are not intended to limit the spirit and scope thereof.

What is claimed is:

1. An improved health pillow construction for receiving the head and neck of the user in a resting position, comprising:

cover means for providing a first wall and second wall;

a partition interposed between said first and second walls, said partition and said first wall defining a first chamber, and said partition and said second wall defining a second chamber;

soft filler material enclosed within said first chamber for comfortably supporting the head; and a firm, elongated neck support member enclosed within said second chamber being slidably movable within said second chamber, so that said neck support member can be easily shifted from one position to another within said second chamber, thereby enabling the user to conveniently adapt the pillow to provide firm support for the user's neck while also providing soft support for the head, said neck support member being of a sufficiently small size relative to the second chamber, whereby a significant change of position of the neck support member may be implemented.

2. The apparatus of claim 1, wherein said firm neck support member is in the shape of a generally cylindrical roll.

3. The apparatus of claim 2, wherein said firm neck support member is made of polyester fiber filler packed within a covered fabric.

4. The apparatus of claim 3 wherein said cover fabric comprises polycotton.

5. The apparatus of claim 1, wherein said firm neck support member comprises a generally cylindrical roll made of hard latex.

6. The apparatus of claim 1, wherein said firm neck support member is made in the shape of a generally cylindrical roll having a diameter approximately in the range of from 20 to 50 percent of its height.

7. The apparatus of claim 1, wherein said cover means for providing first and second walls is made of polycotton fabric.

8. The apparatus of claim 1, wherein said soft filler material comprises loosely packed polyester fiber filler within said first chamber.

9. A method for constructing an improved health pillow for receiving the head and neck of a user in a resting position, comprising the steps of:

providing a cover means having a first and second wall;

interposing a partition between said first and second walls and connecting the edges of said partition and first and second walls together so that said partition and said first wall define a first chamber, and said partition and said second wall define a second chamber;

enclosing within said first chamber a soft filler material for comfortably supporting the head of the user; and enclosing within said second chamber a firm, elongated neck support member so that it is slidably moveable within said second chamber and can be shifted from one position to another to adapt the pillow to provide firm support for the user's neck while also providing soft support for the head, said neck support member being of a sufficiently small size relative to the second chamber, whereby a significant change of position of the neck support member may be implemented.

* * * * *